US010227552B2

(12) United States Patent
Meier et al.

(10) Patent No.: US 10,227,552 B2
(45) Date of Patent: Mar. 12, 2019

(54) AGENT FOR TREATING TEXTILES, CONTAINING AT LEAST ONE ANIONIC, AROMATIC POLYESTER AND AT LEAST ONE NON-IONIC, AROMATIC POLYESTER

(71) Applicant: Henkel AG & Co. KGaA, Duesseldorf (DE)

(72) Inventors: Frank Meier, Duesseldorf (DE); Matthias Sunder, Duesseldorf (DE); Sheila Edwards, Duesseldorf (DE); Thorsten Ott, Moenchengladbach (DE); Martina Hermann, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 114 days.

(21) Appl. No.: 15/512,483

(22) PCT Filed: Sep. 18, 2015

(86) PCT No.: PCT/EP2015/071447
§ 371 (c)(1),
(2) Date: Mar. 17, 2017

(87) PCT Pub. No.: WO2016/042132
PCT Pub. Date: Mar. 24, 2016

(65) Prior Publication Data

US 2017/0292089 A1 Oct. 12, 2017

(30) Foreign Application Priority Data

Sep. 19, 2014 (DE) ..... 10 2014 218 952

(51) Int. Cl.

| | |
|---|---|
| ***C11D 1/00*** | (2006.01) |
| ***C11D 1/83*** | (2006.01) |
| ***C11D 3/37*** | (2006.01) |
| ***C11D 3/00*** | (2006.01) |
| ***C11D 17/04*** | (2006.01) |
| ***C11D 1/37*** | (2006.01) |
| *C11D 1/22* | (2006.01) |
| *C11D 1/28* | (2006.01) |

(52) U.S. Cl.
CPC ..... *C11D 3/3715* (2013.01); *C11D 1/37* (2013.01); *C11D 3/0036* (2013.01); *C11D 17/043* (2013.01); *C11D 17/044* (2013.01); *C11D 17/045* (2013.01); *C11D 1/002* (2013.01); *C11D 1/22* (2013.01); *C11D 1/28* (2013.01)

(58) Field of Classification Search
CPC ..... C11D 1/00; C11D 1/83; C11D 3/0036; C11D 3/3715; C11D 17/045
See application file for complete search history.

(56) References Cited

U.S. PATENT DOCUMENTS

| | | | | |
|---|---|---|---|---|
| 4,161,550 | A | 7/1979 | Bernhardt et al. | |
| 5,142,020 | A | 8/1992 | Kud et al. | |
| 5,599,782 | A | 2/1997 | Pan et al. | |
| 5,786,318 | A | 7/1998 | Blokzijl et al. | |
| 5,948,744 | A | 9/1999 | Baillely et al. | |
| 6,514,927 | B2 | 2/2003 | Lang et al. | |
| 6,579,837 | B1 | 6/2003 | Fleury et al. | |
| 9,422,509 | B2 | 8/2016 | Meier et al. | |
| 2014/0274860 | A1* | 9/2014 | Bankers | C11D 3/2086 510/299 |

FOREIGN PATENT DOCUMENTS

EP 0066944 A1 12/1982

OTHER PUBLICATIONS

EPO, International Search Report and Written Opinion issued in International Application No. PCT/EP2015/071447, dated Feb. 10, 2016.

* cited by examiner

*Primary Examiner* — Brian P Mruk
(74) *Attorney, Agent, or Firm* — Lorenz & Kopf, LLP

(57) ABSTRACT

An agent is provided which is to be used in the treatment of textiles, containing: i) at least one anionic, aromatic polyester, containing at least one structural unit of formula (I), at least one structural unit of formula (II) and at least one structural unit of formula (III) as described herein, and ii) at least one non-ionic, aromatic polyester containing at least one structural unit of formula (IV) and at least one structural unit of formula (V) as described herein, and iii) at least one surfactant. The agent has an excellent primary washing force and can be, in particular, more storage stable than single doses in a multi-chamber bag.

20 Claims, No Drawings

AGENT FOR TREATING TEXTILES, CONTAINING AT LEAST ONE ANIONIC, AROMATIC POLYESTER AND AT LEAST ONE NON-IONIC, AROMATIC POLYESTER

CROSS-REFERENCE TO RELATED APPLICATION

This application is a U.S. National-Stage entry under 35 U.S.C. § 371 based on International Application No. PCT/EP2015/071447, filed Sep. 18, 2015 which was published under PCT Article 21(2) and which claims priority to German Application No. 10 2014 218 952.7, filed Sep. 19, 2014, which are all hereby incorporated in their entirety by reference.

TECHNICAL FIELD

The subject disclosure relates to the technical field of textile treatment, in particular the cleaning of textiles or textile washing.

BACKGROUND

In addition to the ingredients indispensable for the washing process, such as surfactants and builder materials, laundry detergents usually also contain other ingredients, which can be summarized under the term washing auxiliaries and include such diverse groups of active ingredients such as foam regulators, graying inhibitors, soil-release active ingredients, bleaching agents, bleach activators and dye transfer inhibitors. Such auxiliaries also include substances of which the presence enhances the washing power of surfactants, without themselves generally having to exhibit pronounced surfactant behavior. Such substances are often referred to as washing power enhancers.

Soil-release active ingredients, as an auxiliary of a textile treatment agent, prevent dirt from accumulating directly on the surface of textiles and penetrating the textile material (for example the textile fiber), where it can be removed only with difficulty. Equipping the textile surface with what are known as soil-release active ingredients causes dirt to accumulate on the textile surface coated with soil-release active ingredient and thus come into direct contact only with this coating, but not with the textile fiber itself, and also prevents penetration into said textile fiber. The coating, inclusive of dirt, comes off as a result of a repeated washing process.

Document WO 98/58044 discloses laundry detergents that contain polyesters of terephthalic acid with alkylene oxides in combination with a specific anionic surfactant.

Polymers of ethylene terephthalate and polyethylene oxide terephthalate having a molecular weight of 5,000 to 200,000, and their use in liquid laundry detergents are described in German patent DE 28 57 293.

European patent EP 066 944 relates to textile treatment agents which contain a copolyester of ethylene glycol, polyethylene glycol, aromatic dicarboxylic acid and sulfonated aromatic dicarboxylic acid in specific molar ratios.

Document WO 2013/139726 relates to portions in the form of a single dose which comprise liquid laundry detergent provided with a water-soluble wrapping, said liquid laundry detergent containing a copolymer of ethylene terephthalate and polyethylene oxide terephthalate.

Even if the textile surface is not provided beforehand with an active soil-release active ingredient, it has been shown that some soil-release active ingredients can additionally cause an increase in the primary washing power of a laundry detergent on selected stains. It has been found that a soil-release active ingredient does not have this effect on the primary washing power across the entire spectrum of stains equally.

In particular, the removal of stains by one-time washing of soiled test materials under standard conditions is understood to mean the primary washing power. The secondary washing power relates, inter alia, to the extent of graying and encrustation on the textile fibers after repeated washing under standard conditions, for example after 20 or after 50 washes using the selected laundry detergent.

BRIEF SUMMARY

Agents for use in the treatment of textiles are provided herein. In an embodiment, an agent includes at least one anionic, aromatic polyester (i), at least one non-ionic, aromatic polyester (ii), and at least one surfactant (iii). The at least one anionic, aromatic polyester (i) contains at least one structural unit of formula (I), at least one structural unit of formula (II), and at least one structural unit of formula (III)

(I)

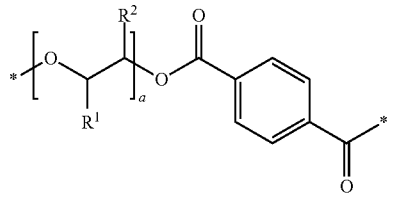

(II)

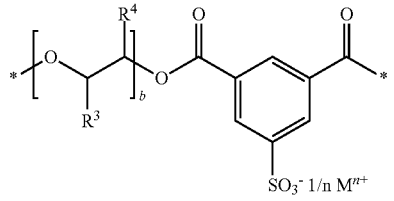

(III)

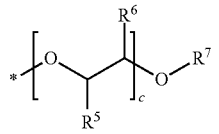

in which a, b and c, independently of one another, each stand for a number from 1 to 200, 1/n $M^{n+}$ stands for an equivalent of a cation having the valence n, with n=1, 2 or 3, $R^1$, $R^2$, $R^3$, $R^4$, $R^5$ and $R^6$, independently of one another, each stand for hydrogen, a $C_1$-$C_{18}$-n-alkyl group, or a $C_3$-$C_{18}$-iso-alkyl group, $R^7$ stands for a linear or branched $C_1$-$C_{30}$ alkyl group, for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, The at least one non-ionic, aromatic polyester (ii) contains at least one structural unit of formula (IV) and at least one structural unit of formula (V)

(IV)

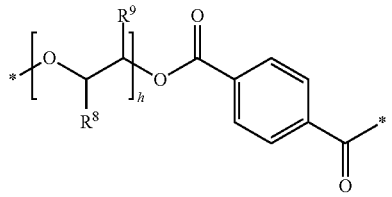

(V)

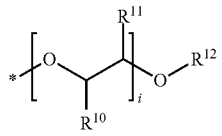

in which h and i, independently of one another, each stand for a number from 1 to 200, $R^8$, $R^9$, $R^{10}$ and $R^{11}$, independently of one another, each stand for hydrogen, a $C_1$-$C_{18}$-n-alkyl group, or -iso-alkyl group, $R^{12}$ stands for a linear or branched $C_1$-$C_{30}$ alkyl group, for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group.

DETAILED DESCRIPTION

The following detailed description is merely exemplary in nature and is not intended to limit the agents as described herein. Furthermore, there is no intention to be bound by any theory presented in the preceding background or the following detailed description.

Increasing the primary washing power enhancement of the soil-release active ingredients can enable a reduction of the amount of surfactant in laundry detergents. One object was therefore to increase the primary washing power of soil-release active ingredients in order to improve the washing performance of the textile treatment agent. A further object was to reduce the surfactant content in textile treatment agents, in particular laundry detergents, without impairing the cleaning performance.

It has now been found that by combining two specific soil-release polymers (vide infra), the primary washing power on the stains specific for one of the soil-release polymers can be increased by adding the other soil-release polymer, although this other soil-release polymer alone does not result in any enhancement, or only results in a marginal enhancement, of the primary washing power on the specific stains of the first-mentioned soil-release polymer. This is observed in particular in the case of greasy stains, in particular such as sebum, engine oil, make up, and shoe polish. Even in the case of stains non-specific for the soil-release polymers, a synergism of the enhancement of the primary washing power was observed as a result of the combination as contemplated herein of said specific soil-release polymers.

In addition, it has been found that the provision of the combination effective as contemplated herein of said polyester soil-release polymers in a surfactant-containing agent for textile treatment (vide infra) is difficult to implement. A combination of said polyesters with surfactants in a clear liquid laundry detergent leads either directly, with the addition of the anionic polyester soil-release polymer, to the deposition of an insoluble solid, or at the latest during storage to a clouding of the liquid laundry agent and to solid deposits. It has been found that agents for use in the treatment of textiles comprising said polyester combination and surfactants should preferably be provided as a portion which is stable under storage and which contains (i) a solid composition with specific, anionic, aromatic polyester, and (ii) a liquid composition with specific, non-ionic, aromatic polyester in a wrapping made of water-soluble material, wherein the portion contains surfactant A first subject as contemplated herein is an agent for use in the treatment of textiles, containing (i) at least one anionic, aromatic polyester, containing at least one structural unit of formula (I), at least one structural unit of formula (II), and at least one structural unit of formula (III)

(I)

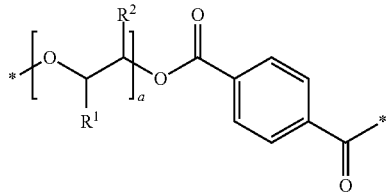

(II)

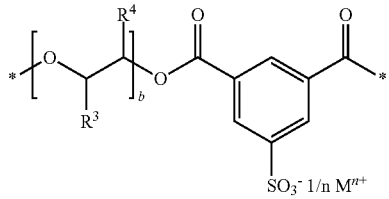

(III)

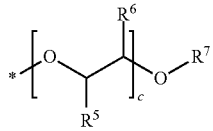

in which a, b and c, independently of one another, each stand for a number from 1 to 200, 1/n $M^{n+}$ stands for an equivalent of a cation having the valence n, with n=1, 2 or 3, $R^1$, $R^2$, $R^3$, $R^4$, $R^5$ and $R^6$, independently of one another, each stand for hydrogen or a $C_1$-$C_{18}$-n-alkyl group or $C_3$-$C_{18}$-iso-alkyl group, $R^7$ stands for a linear or branched $C_1$-$C_{30}$ alkyl group or for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, and (ii) at least one non-ionic, aromatic polyester, containing at least one structural unit of formula (IV) and at least one structural unit of formula (V)

(IV)

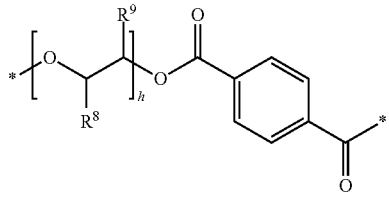

-continued (V)

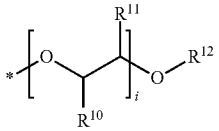

in which h and i, independently of one another, each stand for a number from 1 to 200, $R^8$, $R^9$, $R^{10}$ and $R^{11}$, independently of one another, each stand for hydrogen or a $C_1$-$C_{18}$-n- or -iso-alkyl group, $R^{12}$ stands for a linear or branched $C_1$-$C_{30}$ alkyl group or for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, and (iii) at least one surfactant.

The agents, in addition to the obligatorily contained ingredients, can also contain further optional ingredients. Specified total amounts of ingredients are selected from predefined ranges by weight in such a way that, together with the amounts of the optional ingredients for said agent, they give 100% by weight, in relation to the total weight of said agent In accordance with the instant application, a substance is solid when it is present in the solid state at 25° C. and 1,013 mbar.

In accordance with the instant application, a substance is liquid when it is in the liquid state at 25° C. and 1,013 mbar.

A chemical compound is an organic compound when the molecule of the chemical compound contains at least one covalent bond between carbon and hydrogen.

Conversely to the definition of the organic compound, a chemical compound is an inorganic compound when the molecule of the chemical compound does not contain a covalent bond between carbon and hydrogen.

The term "aromatic" within the sense of the instant application is understood to mean a chemical compound which in the molecule contains at least one structural element satisfying the requirements of aromaticity.

A chemical bond characterized by * in the formulas (I), (II), (III), (IV) and (V) stands for a free valence of the corresponding structural element which in the polymer backbone of the polyester forms an ester bond, for example either to one of said structural elements of formulas (I) or (VI), or (if present) of formula (II) or to a further, at least bivalent structure element. In order to form a polymer terminal, said valences of formulas (I) or (IV) and of formula (II) (if present) bind so as to form an ester bond to the structural element of formula (III) or (V) or to a further, monovalent structural element.

The anionic, aromatic polyesters as contemplated herein are copolyesters that can be formed at least from monomers which, after a polymerization reaction, give corresponding structural units of formulas (I), (II) and (III) at least in the polymer backbone. Such polyesters can be obtained, for example, by polycondensation of terephthalic acid dialkyl esters, 5-sulfoisophthalic acid dialkyl esters, alkylene glycols, optionally polyalkylene glycols (for a, b and/or c>1) and polyalkylene glycols terminally capped at one end. The synthesis of the anionic, aromatic polyesters as contemplated herein can be carried out by known methods, for example by first heating the above-mentioned components with the addition of a catalyst at normal pressure and then building up the necessary molecular weights in a vacuum by distilling off superstoichiometric amounts of the glycols used. For the reaction, the known transesterification and condensation catalysts are suitable, such as titanium tetraisopropylate, dibutyl tin oxide, alkali metal alcoholates or alkaline earth metal alcoholates, or antimony trioxide/calcium acetate. For further details reference is made to EP 442,101.

Said structural units can be present in the polyester molecule of said anionic, aromatic polyester either in block form or randomly distributed.

It is preferred as contemplated herein when the total amount of said anionic, aromatic polyester contained in the agent as contemplated herein contains a number average of 1 to 50 structural units of formula (I) and 1 to 50 structural units of formula (II). Since the number average of the corresponding structural units is calculated over the total amount of said polyester, the values of these and the following number averages from the number of structural units are rational numbers.

Again, the total amount of said contained anionic, aromatic polyester preferably contains, in each case as a number average between 1 and 25, in particular between 1 and 10, particularly preferably between 1 and 5, structural units of formula (I), between 1 and 30, in particular between 2 and 15, particularly preferably between 3 and 10, structural units of formula (II), and between 0.05 and 15, in particular between 0.1 and 10, and particularly preferably between 0.25 and 3, structural units of formula (III).

The anionic, aromatic polyester containing the structural units (I), (II) and (III) and optionally (IV) preferably have number-average molecular weights ranging from about 700 to about 50,000 g/mol, wherein the number-average molecular weight can be determined by means of size exclusion chromatography in aqueous solution using a calibration with the aid of narrow-distribution polyacrylic acid Na salt standard. The number-average molecular weights preferably range from about 800 to about 25,000 g/mol, in particular from about 1,000 to about 15,000 g/mol, particularly preferably from about 1,200 to about 12,000 g/mol.

As contemplated herein, solid, anionic, aromatic polyesters which have softening points above about 40° C. are preferably used as contemplated herein; they preferably have a softening point between about 50 and about 200° C., particularly preferably between about 80° C. and about 150° C., and extraordinarily preferably between about 100° C. and about 120° C.

Anionic, aromatic polyesters that are preferably used have a solid consistency and can be easily ground to give powders or can be compacted or agglomerated to give granules of defined particle sizes. The granulation can be performed in such a way that the copolymers produced during the synthesis as melt are solidified by cooling in a cool gas stream, for example a stream of air or nitrogen, or by application to a flaking roll or to a conveyor belt to give flakes. This coarse material can be further ground as appropriate, for example in a roller mill or in a screen mill, which can follow a screening and a rounding as presented above. The granulation can also take place by grinding the polyesters after solidification to give powders and then converting them to granules having defined particles sizes by means of compaction and/or agglomeration and the above-described rounding.

It is preferred as contemplated herein when 1/n $M^{n+}$ according to formula (II) stands for $Li^+$, $Na^+$, $K^+$, ½$Mg^{2+}$, $\frac{1}{2}Ca^{2+}$, $\frac{1}{3}Al^{3+}$, $NH_4^+$, monoalkyl-dialkyl-, trialkyl- or tetraalkaylammonium, wherein the alkyl groups of the ammonium ions are $C_1$-$C_{22}$ alkyl groups or $C_2$-$C_{10}$ hydroxyalkyl groups or any mixtures thereof.

What are preferred are anionic aromatic polyesters in which, accordingly in formulas (I), (II) and (III), $R^1$, $R^2$, $R^3$, $R^4$, $R^5$ and $R^6$, independently of one another, each stand for hydrogen or methyl, $R^7$ stands for methyl, and/or a, b and c, independently of one another, each stand for a number from 1 to 200, in particular 1 to 20, particularly preferably 1 to 5, wherein extraordinarily preferably a and b=1, and/or c is a number from 2 to 10.

Again, the total amount of said anionic, aromatic polyester contained in the agent as contemplated herein preferably contains, as a number average between 1 and 25, in particular between 1 and 10, particularly preferably between 1 and 5, structural units of formula (I), between 1 and 30, in particular between 2 and 15, particularly preferably between 3 and 10, structural units of formula (II), and between 0.05 and 15, in particular between 0.1 and 10, and particularly preferably between 0.25 and 3, structural units of formula (III).

Anionic, aromatic polyesters that are very particularly preferably contained are those in which, accordingly in formulas (I), (II) and (III), $R^1$, $R^2$, $R^3$, $R^4$, $R^5$ and $R^6$, independently of one another, each stand for hydrogen or methyl, $R^7$ stands for methyl, and/or a, b and c, independently of one another, each stand for a number from 1 to 200, in particular 1 to 20, particularly preferably 1 to 5, wherein extraordinarily preferably a and b=1 and c is a number from 2 to 10, wherein the total amount of said anionic, aromatic polyester contained in the agent as contemplated herein contains, as a number average between 1 and 25, in particular between 1 and 10, particularly preferably between 1 and 5, structural units of formula (I), between 1 and 30, in particular between 2 and 15, particularly preferably between 3 and 10, structural units of formula (II), and between 0.05 and 15, in particular between 0.1 and 10, and particularly preferably between 0.25 and 3, structural units of formula (III).

Such polyesters can be obtained, for example, by polycondensation of terephthalic acid dialkyl esters, 5-sulfoisophthalic acid dialkyl esters, alkylene glycols, optionally polyalkylene glycols (for a, b and/or c>1) and polyalkylene glycols terminally capped at one end (in accordance with the unit of formula III).

An ester of terephthalic acid having one or more difunctional, aliphatic alcohols is a potential unit of formula (I), and ethylene glycol ($R^1$ and $R^2$ each H) and/or 1,2-propylene glycol ($R^1$=H and $R^2$=—$CH_3$ or vice versa) and/or shorter-chain polyethylene glycols and/or poly[ethylene glycol-co-propylene glycol] with number-average molecular weights from 100 to about 2,000 g/mol are preferably used here.

An ester of 5-sulfoisophthalic acid having one or more difunctional, aliphatic alcohols is a potential unit of formula (II), and the above-mentioned are preferably used here.

Poly[ethylene glycol-co-propylene glycol]-monomethyl ethers having number-average molecular weights from 100 to about 2,000 g/mol and polyethylene glycol monomethyl ethers of general formula $CH_3$—O—$(C_2H_4O)_n$—H with n=1 to 99, in particular 1 to 20, and particularly preferably 2 to 10, are preferably used as polyalkylene glycol monoalkyl ethers non-ionically capped at one end according to the unit of formula (III). Since, by using such ethers capped at one end, the theoretical maximum mean molecular weight of a polyester structure to be attained with quantitative conversion is predefined, the preferred amount of the structural unit (III) to be used is that necessary for achieving preferred mean molecular weights (vide supra).

In a specific embodiment as contemplated herein the anionic, aromatic polyester as contemplated herein additionally contains a structural unit of formula VI $$-[\text{polyfunctional unit}]_g \qquad \text{(VI)}$$

in which g stands for a number from 0 to 5, and polyfunctional unit stands for a unit having 3 to 6 free valences which can bind to the polymer structure via ester groups.

Apart from linear polyesters resulting from the structural units (I), (II) and (III), the use of cross-linked or branched polyester structures is also included as contemplated herein. This is expressed by the presence of a polyfunctional structural unit (VI) that has a cross-linking effect and that comprises at least three to at most 6 functional groups capable of the esterification reaction. Functional groups can include here, for example, acid, alcohol, ester, anhydride or epoxy groups. Here, different functionalities in one molecule are also possible. Examples of this can include citric acid, malic acid, tartaric acid and gallic acid, particularly preferably 2,2-dihydroxymethylpropionic acid. Furthermore, polyvalent alcohols can also be used, such as pentaerythritol, glycerol, sorbitol and trimethylolpropane. These can also be polyvalent aliphatic or aromatic carboxylic acids, such as benzene-1,2,3-tricarboxylic acid (hemimellitic acid), benzene-1,2,4-tricarboxylic acid (trimellitic acid), or benzene-1,3,5-tricarboxylic acid (trimesitic acid). The proportion by weight of cross-linking monomers, in relation to the total mass of the anionic, aromatic polyester, can be, for example, up to about 10% by weight, in particular about 5% by weight, and particularly preferably up to about 3% by weight.

The anionic, aromatic polyesters are contained in the agent as contemplated herein in a total amount of from about 0.5 to about 8.0% by weight, in particular about 1.0 to about 5.0% by weight, in each case in relation to the weight of the total agent.

The non-ionic, aromatic polyesters as contemplated herein are copolyesters that can be formed at least from monomers which, after a polymerization reaction, give corresponding structural units of formulas (IV) and (V). Such polyesters can be obtained, for example, by polycondensation of terephthalic acid dialkyl esters, alkylene glycols, optionally polyalkylene glycols (for h and/or i>1) and polyalkylene glycols terminally capped at one end. The synthesis of the non-anionic, aromatic polyesters as contemplated herein can be carried out by known methods, for example by first heating the above-mentioned components with the addition of a catalyst at normal pressure and then building up the necessary molecular weights in a vacuum by distilling off superstoichiometric amounts of the glycols used. For the reaction, the known transesterification and condensation catalysts are suitable, such as titanium tetraisopropylate, dibutyl tin oxide, alkali metal alcoholates or alkaline earth metal alcoholates, or antimony trioxide/calcium acetate.

Preferred agents as contemplated herein contain at least one non-ionic, aromatic polyester, in which, accordingly in formulas (IV) and (V)

$R^8$, $R^9$, $R^{10}$ and $R^{11}$, independently of one another, each stand for hydrogen or methyl and/or, $R^{12}$ stands for methyl, and/or h and i, independently of one another, each stand for a number from 1 to 200, in particular 1 to 20, particularly preferably 1 to 5, wherein extraordinarily preferably h=1 and/or i is a number from 2 to 10.

Again, the total amount of said non-anionic, aromatic polyester contained in the agent as contemplated herein preferably contains, as a number average between 1 and 25, in particular between 1 and 10, particularly preferably between 1 and 5, structural units of formula (IV), between 0.05 and 15, in particular between 0.1 and 10, and particularly preferably between 0.25 and 3, structural units of formula (V).

Non-ionic, aromatic polyesters contained very particularly preferably in the agent are those with corresponding formulas (IV) and (V), in which $R^8$, $R^9$, $R^{10}$ and $R^{11}$, independently of one another, each stand for hydrogen or methyl and/or, $R^{12}$ stands for methyl, and/or h and i, independently of one another, each stand for a number from 1 to 200, in particular 1 to 20, particularly preferably 1 to 5 (extraordinarily preferably h=1 and/or i is a number from 2 to 10), wherein the total amount of said non-ionic, aromatic polyester contained in the agent as contemplated herein contains, as a number average between 1 and 25, in particular between 1 and 10, particularly preferably between 1 and 5, structural units of formula (IV), between 0.05 and 15, in particular between 0.1 and 10, and particularly preferably between 0.25 and 3, structural units of formula (V).

Such polyesters can be obtained, for example, by polycondensation of terephthalic acid dialkyl esters, alkylene glycols, optionally polyalkylene glycols (for h and/or i>1) and polyalkylene glycols terminally capped at one end (in accordance with the unit of formula V).

The unit of formula (IV) derives preferably from an ester of 1,4-terephthalic acid having one or more difunctional, aliphatic alcohols. Preferred difunctional, aliphatic alcohols are selected from at least one compound of the group formed from ethylene glycol ($R^8$ and $R^9$ each H), 1,2-propylene glycol ($R^8$=H and $R^9$=—$CH_3$ or vice versa), shorter-chain polyethylene glycols (in particular 1,3-propylene glycol, 1,4-butanediol, 1,5-pentanediol, 1,6-hexanediol, 1,8-octanediol, 1,2-decanediol, 1,2-dodecanediol and neopentyl glycol) and poly[ethylene glycol-co-propylene glycol] with number-average molecular weights from 100 to about 2,000 g/mol.

Poly[ethylene glycol-co-propylene glycol]-monomethyl ethers having number-average molecular weights from 100 to about 2,000 g/mol and polyethylene glycol monomethyl ethers of general formula $CH_3$—O—$(C_2H_4O)_n$—H with n=1 to 99, in particular 1 to 20, and particularly preferably 2 to 10, are preferred polyalkylene glycol monoalkyl ethers non-ionically capped at one end, from which the unit of formula (V) preferably derives. Since, by using such ethers capped at one end, the theoretical maximum mean molecular weight of a polyester structure to be attained with quantitative conversion is predefined, the preferred amount of the structural unit (V) to be used is that necessary for achieving preferred mean molecular weights (vide infra).

It has been found that preferred suitable non-ionic, aromatic polyesters contain at least one structural unit of formula (IV) in which h=1. The agent as contemplated herein therefore preferably contains at least one non-anionic, aromatic polyester, containing at least one structural unit of formula (IV-1) and at least one structural unit of formula (V) and optionally at least one structural unit of formula (IV)

(IV-1)

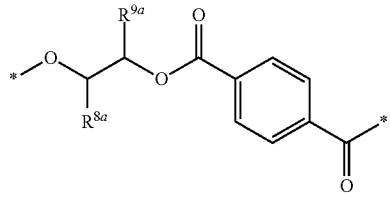

(IV)

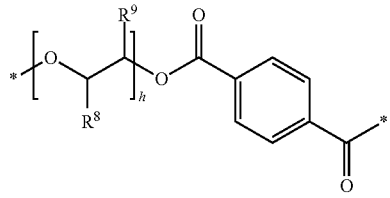

(V)

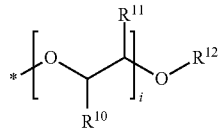

in which h and i, independently of one another, each stand for a number from 2 to 20, $R^8$, $R^9$, $R^{8a}$, $R^{9a}$, $R^{10}$ and $R^{11}$, independently of one another, each stand for hydrogen or a $C_1$-$C_{18}$-n- or -iso-alkyl group, $R^{12}$ stands for a linear or branched $C_1$-$C_{30}$ alkyl group or for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, A chemical bond characterized by * in the formula (IV-a) has the same meaning as in formula (IV) (vide supra).

It is also preferred within the scope of this embodiment when, in formulas (IV), (IV-1) and (V), $R^8$, $R^9$, $R^{8a}$, $R^{9a}$, $R^{10}$ and $R^{11}$, independently of one another, each stand for hydrogen or methyl and/or, $R^{12}$ stands for methyl, and h and i, independently of one another, each stand for a number from 2 to 20 (h is particularly preferably a number from 2 to 5 and i is a number from 2 to 10).

The non-ionic, aromatic polyester containing the structural units (IV), (V) and optionally further structural units preferably have number-average molecular weights ranging from about 700 to about 50,000 g/mol, wherein the number-average molecular weight can be determined by means of size exclusion chromatography in aqueous solution using a calibration with the aid of narrow-distribution polyacrylic acid Na salt standard. The number-average molecular weights preferably range from about 800 to about 25,000 g/mol, in particular from about 1,000 to about 15,000 g/mol, particularly preferably from about 1,200 to about 12,000 g/mol.

It is preferred as contemplated herein when the total amount of said anionic, aromatic polyester contained in the agent as contemplated herein contains, as a number average, 1 to 50 structural units of formula (IV) and 1 to 50 structural units of formula (V). Again, the total amount of said non-anionic, aromatic polyester contained in the agent as contemplated herein preferably contains, as a number average, between 1 and 25, in particular between 1 and 10, particularly preferably between 1 and 5, structural units of formula (IV) (preferably of formula (IV-1)), between 0.05 and 15, in particular between 0.1 and 10, and particularly preferably between 0.25 and 3, structural units of formula (V).

End-group-capped polyesters obtained from the esterification of polyethylene glycol monoethyl ether, terephthalic acid, and ethylene glycol and/or 1,2-propylene glycol are very particularly preferably used as non-anionic, aromatic polyester.

The non-ionic, aromatic polyesters are contained in the agent as contemplated herein in a total amount of from about 0.5 to about 8.0% by weight, in particular about 1.0 to about 5.0% by weight, in each case in relation to the weight of the total agent.

The agent as contemplated herein obligatorily contains at least one surfactant. Anionic surfactants, cationic surfactants, amphoteric surfactants, and also non-ionic surfactants can be used as surfactant.

Within the scope of a preferred embodiment the agent as contemplated herein contains surfactant in a total amount of from about 40 to about 70% by weight, in particular from about 50 to about 60% by weight.

It is preferred as contemplated herein when the agent as contemplated herein contains at least one anionic surfactant and at least one non-ionic surfactant.

Sulfonates and/or sulfates can be used preferably as anionic surfactant. The preferred total amount of anionic surfactant in the agent as contemplated herein is about 7.5 to about 65.0% by weight, and preferably about 20.0 to about 45% by weight, in each case in relation to the total agent as contemplated herein.

Here, $C_9$-$C_{13}$ alkylbenzene sulfonates, olefin sulfonates, i.e. mixtures of alkene and hydroxyalkane sulfonates, and also disulfonates, as are obtained for example from $C_{12-18}$ monoolefins having a terminal or internal double bond by sulfonation with gaseous sulfur trioxide and subsequent alkaline or acidic hydrolysis of the sulfonation products, can be considered as surfactants of the sulfonate type. $C_{12-18}$ alkane sulfonates and the esters of α-sulfo fatty acids (ester sulfonates), for example the α-sulfonated methyl esters of hydrogenated coconut, palm kernel or tallow fatty acids, are also suitable.

The alkali salts and in particular the sodium salts of sulfuric acid half esters of $C_{12}$-$C_{18}$ fatty alcohols, for example from coconut fatty alcohol, tallow fatty alcohol, lauryl, myristyl, cetyl or stearyl alcohol or $C_{10}$-$C_{20}$ oxo alcohols and the half esters of secondary alcohols of these chain lengths are preferred as alk(en)yl sulfates. The $C_{12}$-$C_{16}$ alkyl sulfates and $C_{12}$-$C_{15}$ alkyl sulfates and also $C_{14}$-$C_{15}$ alkyl sulfates are preferred from a washing perspective. 2,3-alkyl sulfates are also suitable anionic surfactants.

Fatty alcohol ether sulfates, such as the sulfuric acid mono esters of the straight-chain or branched $C_{7-21}$ alcohols ethoxylated with 1 to 6 mol of ethylene oxide, such as 2-methyl-branched $C_9$. 11 alcohols having on average 3.5 mol ethylene oxide (EO) or $C_{12-18}$ fatty alcohols with 1 to 4 EO, are also suitable.

Further suitable anionic surfactants are soaps. Saturated and unsaturated fatty acid soaps are suitable, such as the salts of lauric acid, myristic acid, palmitic acid, stearic acid, (hydrogenated) erucic acid and behenic acid, and also in particular soap mixtures derived from natural fatty acids, for example coconut, palm kernel, olive oil, or tallow fatty acids.

The anionic surfactants and also the soaps can be present in the form of their sodium, potassium, or magnesium or ammonium salts. The anionic surfactants are preferably present in the form of their ammonium salts. Preferred counterions for the anionic surfactants are the protonated forms of choline, triethylamine, monoethanolamine, or methylethylamine.

In a very particularly preferred embodiment, the agent as contemplated herein contains an alkylbenzene sulfonic acid neutralized with monoethanolamine, in particular $C_{9-13}$ alkylbenzene sulfonic acid, and/or a fatty acid neutralized with monoethanolamine.

Suitable non-ionic surfactants include alkoxylated fatty alcohols, alkoxylated fatty acid alkyl esters, fatty acid amides, alkoxylated fatty acid amides, polyhydroxy fatty acid amides, alkylphenol polyglycol ethers, amine oxides, alkyl polyglucosides, and mixtures thereof.

Alkoxylated, advantageously ethoxylated, in particular primary alcohols containing preferably 8 to 18 C atoms and on average 1 to 12 mol ethylene oxide (EO) per mol of alcohol, in which the alcohol group can be linear or preferably methyl-branched in the 2-position or can contain linear and methyl-branched groups in the mixture, as are normally present in oxo alcohol groups, are preferably used as non-ionic surfactant. However, alcohol ethoxylates with linear groups formed of alcohols of native origin containing 12 to 18 C atoms, for example formed of coconut, palm, tallow fatty, or oleyl alcohol, and containing on average 5 to 8 EO per mol of alcohol are preferred in particular. By way of example, the preferred ethoxylated alcohols include C12-14 alcohols containing 4 EO or 7 EO, $C_{9-11}$ alcohol containing 7 EO, $C_{13-15}$ alcohols containing 5 EO, 7 EO or 8 EO, $C_{12-18}$ alcohols containing 5 EO or 7 EO, and mixtures thereof. The specified degrees of ethoxylation are statistical average values, which can be a whole number or a fractional number for a particular product. Preferred alcohol ethoxylates have a narrowed homologue distribution (narrow range ethoxylates, NREs). In addition to these non-ionic surfactants, fatty alcohols containing more than 12 EO can also be used. Examples of these include tallow fatty alcohol containing 14 EO, 25 EO, 30 EO or 40 EO. Non-ionic surfactants that contain the EO and PO groups together in the molecule can be used as contemplated herein. A mixture of a (more strongly) branched ethoxylated fatty alcohol and an unbranched ethoxylated fatty alcohol, such as a mixture of a $C_{16-18}$ fatty alcohol containing 7 EO and 2-propylheptanol containing 7 EO, are also suitable. The agent as contemplated herein particularly preferably contains a $C_{12-18}$ fatty alcohol containing 7 EO, a $C_{13-15}$ oxo alcohol containing 7 EO and/or a $C_{13-15}$ oxo alcohol containing 8 EO as non-ionic surfactant.

The total amount of non-ionic surfactant of the agent as contemplated herein is preferably about 0.1 to about 25.0% by weight and preferably about 7.0 to about 22.0% by weight, in each case in relation to the total agent as contemplated herein.

As further ingredient, the agent as contemplated herein preferably contains at least one polysaccharide within the scope of a further preferred embodiment.

A polysaccharide is understood to mean saccharides as contemplated herein which contain at least 10 glycosidically linked sugar structural units.

Within the scope of a preferred embodiment the polysaccharide is present in the form of particles (preferably in the form of a powder or granules, particularly preferably granules). Here, it is again preferred when these particles have a mean particle size (volume mean) $X_{50.3}$ of from about 200 to about 1,600 μm, in particular from about 300 to about 1,400 μm, in particular from about 400 to about 1,200 μm, very particularly preferably from about 600 to about 1,100 μm (for example measured with sieve analysis or by a Camsizer particle size analyzer from the company Retsch).

Preferred polysaccharides are celluloses and derivatives thereof, starch and derivatives thereof, and mixtures thereof. As polysaccharide, the solid composition as contemplated herein preferably contains methyl cellulose, and ethyl cellulose, hydroxyethyl cellulose, hydroxypropyl cellulose, methyl hydroxyethyl cellulose, methyl carboxymethyl cellulose, ethyl hydroxyethyl cellulose, carboxymethyl cellulose (CMC), an ether sulfonic acid salt of starch, an ether sulfonic acid salt of cellulose, an acidic sulfuric acid ester salt of cellulose, an acidic sulfuric acid ester salt of starch, or a mixture of at least two of these polysaccharides.

The effect as contemplated herein is particularly pronounced when, as polysaccharide, at least one polysaccharide comprising at least one anionic group in the solid composition as contemplated herein is contained. Groups covalently bonded to the polysaccharide which are capable, in protic solvent, of forming an anion with formal delivery of an $H^+$ ion, in particular such as carboxyl groups (—COOH), sulfonic acid groups (—$SO_3H$), sulfate groups (—O—$SO_3H$), and phosphonic acid groups (—$PO_3H$), act as anionic groups. What is preferred is the use of at least one polysaccharide containing at least one carboxyl group, particularly preferably at least one carboxy alkyl-derivatized polysaccharide. As contemplated herein, a carboxyl group is understood to mean both the acid form —COOH and the deprotonated salt form (carboxylate group) having a corresponding cation as counterion. Monovalent ions, such as sodium ions, potassium ions, and ammonium ions are particularly suitable as corresponding cations. This is true, mutatis mutandis, for carboxyalkyl-derivatized polysaccharide.

In a preferred embodiment, at least one anionic polysaccharide selected from anionic cellulose, anionic starch, or mixtures thereof is contained as polysaccharide in the agent as contemplated herein. Here, it is again preferred when the polysaccharide is selected from carboxyalkyl-derivatized cellulose, carboxyalkyl-derivatized starch, or mixtures thereof. Carboxyalkyl-derivatized cellulose is very particularly preferred as contemplated herein.

The preferred total amount of polysaccharide in the agent as contemplated herein, in particular the amount of preferred polysaccharide (vide supra) (particularly preferably the amount of carboxymethyl cellulose), is about 0.25 to about 7.5% by weight, in particular from about 1.0 to about 5.0% by weight, very particularly preferably from about 1.5 to about 3.5% by weight, in each case in relation to the weight of said composition.

The agents as contemplated herein additionally contain at least one polyalkoxylated amine within the scope of a further preferred embodiment.

The polyalkoxylated polyamine within the scope of the subject disclosure and individual aspects thereof is a polymer having a backbone which contains an N atom and which carries polyalkoxy groups at the N atoms. The polyamine has primary amino functions at the ends (terminal and/or side chains) and internally preferably has both secondary and tertiary amino functions; it may also comprise merely secondary amino functions internally as appropriate, such that a linear polyamine is provided, rather than a branch-chained polyamine. The ratio of primary to secondary amino groups in the polyamine lies preferably in a range of from about 1:0.5 to about 1:1.5, in particular in a range of from about 1:0.7 to about 1:1. The ratio of primary to tertiary amino groups in the polyamine lies preferably in a range of from about 1:0.2 to about 1:1, in particular in a range of from about 1:0.5 to about 1:0.8. The polyamine preferably has a mean molar mass ranging from about 500 g/mol to about 50,000 g/mol, in particular from about 550 g/mol to about 5,000 g/mol. The N atoms in the polyamine are separated from one another by alkylene groups, preferably by alkylene groups having 2 to 12 C atoms, in particular 2 to 6 C atoms, wherein not all alkylene groups have to have the same number of C atoms. Ethylene groups, 1,2-propylene groups, 1,3-propylene groups, and mixtures thereof are particularly preferred. Polyamines which carry ethylene groups as said alkylene groups are also referred to as polyethylene imine or PEI. PEI is a polymer with a backbone containing an N atom that is particularly preferred as contemplated herein.

The primary amino functions in polyamine can carry 1 or 2 polyalkoxy groups, and the secondary amino functions can carry 1 polyalkoxy group, wherein not each amino function has to be alkoxy group-substituted. The average number of alkoxy groups per primary and secondary amino function in the polyalkoxylated polyamine is preferably 1 to 100, in particular 5 to 50. The alkoxy groups in the polyalkoxylated polyamine are preferably polypropoxy groups which are directly bonded to N atoms, and/or are polyethoxy groups which are bonded to propoxy groups (provided as appropriate) and to N atoms not carrying any propoxy groups.

Polyethoxylated polyamines are obtained by reacting polyamines with ethylene oxide (EO for short). The polyalkoxylated polyamines, which contain ethoxy and propoxy groups, are preferably accessible by reacting polyamines with propylene oxide (PO for short) and by subsequent reaction with ethylene oxide.

The average number of propoxy groups per primary and secondary amino function in the polyalkoxylated polyamine is preferably 1 to 40, in particular 5 to 20.

The average number of ethoxy groups per primary and secondary amino function in the polyalkoxylated polyamine is preferably 10 to 60, in particular 15 to 30.

If desired, the terminal OH-function polyalkoxy substituents in the polyalkoxylated polyamine are etherified in part or completely with a $C_1$-$C_{10}$, in particular $C_1$-$C_3$ alkyl group.

Polyalkoxylated polyamines which are particularly preferred as contemplated herein can be selected from polyamine reacted with 45EO per primary and secondary amino function, PEIs reacted with 43EO per primary and second amino function, PEIs reacted with 15EO+5PO per primary and secondary amino function, PEIs reacted with 15PO+30 EO per primary and secondary amino function, PEIs reacted with 5PO+39.5EO per primary and secondary amino function, PEIs reacted with 5PO and 15EO per primary and secondary amino function, PEIs reacted with 10PO+35EO per primary and secondary amino function, PEIs reacted with 15PO+30EO per primary and secondary amino function, and PEIs reacted with 15PO and 5EO per primary and secondary amino function. A very particularly preferred alkoxylated polyamine is PEI with a content of from 10 to 20 nitrogen atoms reacted with 20 units EO per primary and secondary amino function of the polyamine.

A further embodiment as contemplated herein is the use of polyalkoxylated polyamines which are obtainable by reacting polyamines with ethylene oxide and additionally propylene oxide as appropriate. If polyamines polyalkoxylated with ethylene oxide and propylene oxide are used, the proportion of propylene oxide in the total amount of the alkylene oxide is preferably about 2 mol % to about 18 mol %, in particular about 8 mol % to about 15 mol %.

The agent as contemplated herein, in relation to the total weight thereof, contains polyalkoxylated polyamines preferably in a total amount of from about 0.25 to about 7.5% by weight, in particular from about 1.0 to about 5.0% by weight.

The agents as contemplated herein, in relation to the total weight of the agent, can contain a total amount of additional organic polymer of at least about 1.0% by weight, in particular of at least about 10% by weight. The additional organic polymer is different from the anionic, aromatic polyesters as contemplated herein and the non-ionic, aromatic polyesters as contemplated herein and has a weight-average molecular weight of at least about 1,000 g/mol. In particular, the aforementioned polysaccharides, aforementioned polyalkoxylated polyamines, polymer skeleton materials specified hereinafter, and the dye transfer inhibitors mentioned hereinafter fall under the additional organic polymers.

The agent as contemplated herein can additionally contain at least one peroxide compound (in particular in an amount of from about 5 to about 20% by weight). Within the scope of a further preferred embodiment, however, it is preferred when the agent as contemplated herein, in relation to the total weight thereof, comprises a total amount of from 0 to about 1% by weight, in particular from 0 to about 0.5% by weight, particularly preferably from 0 to about 0.01% by weight, of peroxide compound. The agent as contemplated herein is very particularly preferably free from a peroxide compound. A peroxide compound is a chemical compound which contains the peroxo atom grouping —O—O— as structure fragment.

The agent as contemplated herein is particularly stable under storage and effective when it comprises at least two compositions, wherein one of these compositions is a solid composition and a further of these compositions is a liquid composition. Here, it has proven to be advantageous when the agent as contemplated herein is provided in the form of a portion, comprising at least two chambers with walls made of water-soluble material, wherein, in each case, (i) at least one of these chambers contains a solid composition comprising the previously defined, anionic, aromatic polyester (vide supra), and
(ii) at least one further of these chambers contains a liquid composition comprising the previously defined non-ionic, aromatic polyester (vide supra), wherein the portion contains at least one surfactant.

A portion is an independent dosing unit comprising at least one chamber, in which a content to be dosed is contained. A chamber is a space delimited by walls (for example by a film) and which can also exist without the content to be dosed (possibly in amended form). A layer of a surface coating therefore explicitly does not fall under the definition of a wall.

The walls of the chamber are made of a water-soluble material. The water solubility of the material can be determined with the aid of a square film of said material (film: 22×22 mm with a thickness of 76 μm) fixed in a square frame (edge length on the inner side: 20 mm) in accordance with the following measurement protocol. Said framed film is immersed in 800 mL of distilled water, controlled to a temperature of 20° C., in a 1 liter glass beaker with circular base surface (company Schott, Mainz, 1,000 mL glass beaker, low style), such that the area of the clamped film is arranged at right angles to the base surface of the glass beaker, the upper edge of the frame is 1 cm below the water surface, and the lower edge of the frame is oriented parallel to the base surface of the glass beaker, in such a way that the lower edge of the frame runs along the radius of the base surface of the glass beaker and the middle of the lower edge of the frame is arranged above the middle of the radius of the glass beaker base. The material should dissolve within 600 seconds with stirring (stirring speed of magnetic stirrer 300 rpms, stirring rod: 6.8 cm long, diameter 10 mm), in such a way that individual solid film particles are no longer visible with the naked eye.

The portion obligatorily comprises water-soluble material in order to form the delimiting wall of the at least one chamber. The water-soluble material is preferably formed by a water-soluble film material. As contemplated herein, this film can preferably have a thickness of at most about 150 μm (particularly preferably of at most about 120 μm). Preferred walls are therefore made from a water-soluble film and have a thickness of at most about 150 μm (particularly preferably of at most about 120 μm, very particularly preferably of at most about 100 μm).

Such water-soluble portions can be produced either by vertical form fill sealing (VVFS) or hot-forming methods.

The hot-forming method generally includes the forming of a first layer from a water-soluble film material so as to form at least one cavity for receiving, in each case, at least one composition therein, filling the composition into the corresponding cavity, covering the cavities filled with the composition with a second layer made of a water-soluble film material, and sealing the first and second layers with one another, at least around the cavities.

The water-soluble material preferably contains at least one water-soluble polymer. In addition, the water-soluble material preferably contains a water-soluble film material selected from polymers or polymer mixtures. The walls of the portion can be formed from one or from two or more layers made of the water-soluble film material. The water-soluble film material of the first layer and the further layers, if provided, can be the same or different.

The water-soluble material preferably contains polyvinyl alcohol or a polyvinyl alcohol copolymer.

Suitable water-soluble films as water-soluble material are preferably based on a polyvinyl alcohol or a polyvinyl alcohol copolymer of which the molecular weight in each case lies in a range from about 10,000 to about 1,000,000 $gmol^{-1}$, preferably from about 20,000 to about 500,000 $gmol^{-1}$, particularly preferably from about 30,000 to about 100,000 $gmol^{-1}$, and in particular from about 40,000 to about 80,000 $gmol^{-1}$.

Polyvinyl alcohol is usually produced by hydrolysis of polyvinyl acetate, since the direct synthesis path is not possible. The same is true for polyvinyl alcohol copolymers, which are produced accordingly from polyvinyl acetate copolymers. It is preferred when at least one layer of the water-soluble material comprises a polyvinyl alcohol of which the degree of hydrolysis makes up from about 70 to about 100 mol %, preferably about 80 to about 90 mol %, particularly preferably about 81 to about 89 mol %, and in particular about 82 to about 88 mol %.

In addition, polymers selected from the group comprising acrylic acid-containing polymers, polyacrylamides, oxazolin polymers, polystyrene sulfonates, polyurethanes, polyesters, polyethers, polylactic acid, and/or mixtures of the above-mentioned polymers, can be added to the film material suitable as water-soluble material.

Preferred polyvinyl alcohol copolymers, in addition to vinyl alcohol, also comprise dicarboxylic acids as further monomers. Suitable dicarboxylic acids are itaconic acid, malonic acid, succinic acid, and mixtures thereof, wherein itaconic acid is preferred.

Further preferred polyvinyl alcohol copolymers, in addition to vinyl alcohol, also comprise an ethylenically unsaturated carboxylic acid, salt thereof, or ester thereof. Such polyvinyl alcohol copolymers, in addition to vinyl alcohol, particularly preferably also contain acrylic acid, methacrylic acid, acrylic acid ester, methacrylic acid ester, or mixtures thereof.

It is also preferred when the water-soluble material contains polyvinyl alcohol or a polyvinyl alcohol copolymer, and at least one bitter substance, in particular denatonium benzoate, is incorporated into the water-soluble material. The concentration of bitter substance in the water-soluble material is preferably at most 1 part by weight bitter substance to 250 parts by weight of the total water-soluble material.

Suitable water-soluble films for use as water-soluble material of the portion as contemplated herein are films sold under the name Monosol M8630 by MonoSol LLC. Other suitable films comprise films having the name Solublon® PT, Solublon® KA, Solublon® KC or Solublon® KL from Aicello Chemical Europe GmbH, or the films VF-HP from Kuraray.

The aforementioned embodiments that are preferred as contemplated herein of said aromatic polyesters and also of the surfactants, the alkoxylated polyamines, the polysaccharides, and the peroxide compound are each also preferred, mutatis mutandis, for the embodiments of the agents as contemplated herein provided in the form of a portion.

It has proven to be preferable when the solid composition of the portion as contemplated herein is formed from a plurality of solid particles. Such an embodiment of the solid composition is preferably provided in the form of a powder or granules. Said solid particles again preferably have a particle diameter (X50) of about 100-1,500 μm. These particles sizes can be determined by sieving or by means of a Camsize particle size analyzer from the company Retsch.

The solid composition as contemplated herein of the portion preferably contains at least one polysaccharide. The above definitions and preferred embodiments of the polysaccharide also apply here.

The preferred total amount of polysaccharide in the solid composition, in particular the amount of preferred polysaccharide (vide supra) (particularly preferably the amount of carboxymethyl cellulose), is about 1.0 to about 15.0% by weight, in particular from about 2.0 to about 12.0% by weight, very particularly preferably from about 2.5 to about 9.5% by weight, in each case in relation to the weight of said composition.

The portion preferably contains the solid composition in a total amount of from about 4.0 to about 10.0 g, in particular from about 5.0 to about 9.0 g.

The portion preferably contains the liquid composition in a total amount of from about 10.0 to about 20.0 g, in particular from about 14.0 to about 18.0 g.

The composition provided in liquid form in the portion can contain water, wherein, in particular for liquid first compositions, the content of water in relation to the total first composition is at most about 20% by weight, preferably at most about 15% by weight.

The total amount of surfactant in the liquid composition of the portion is preferably up to about 85% by weight, preferably about 40 to about 75% by weight, and particularly preferably about 50 to about 70% by weight, in each case in relation to the total liquid composition of the portion.

Within the scope of a further preferred embodiment, the liquid composition of the portion contains at least one alkoxylated polyamine. The aforementioned definitions and preferred embodiments of the alkoxylated polyamine apply.

A particularly preferred embodiment as contemplated herein is an agent as contemplated herein in the form of a portion, comprising at least two chambers with walls made of water-soluble material, wherein, in each case, (i) at least one of these chambers contains a solid composition comprising the previously defined, anionic, aromatic polyester (vide supra) and at least one polysaccharide, and (ii) at least one further of these chambers contains a liquid composition comprising the previously defined non-ionic, aromatic polyester (vide supra) and at least one alkoxylated polyamine, wherein the portion contains at least one surfactant.

A very particularly preferred embodiment as contemplated herein is an agent as contemplated herein in the form of a portion, comprising at least two chambers with walls made of water-soluble material, wherein, in each case, (i) at least one of these chambers contains a solid composition containing at least one anionic, aromatic polyester containing at least one structural unit of formula (I), at least one structural unit of formula (II), and at least one structural unit of formula (III)

(I)

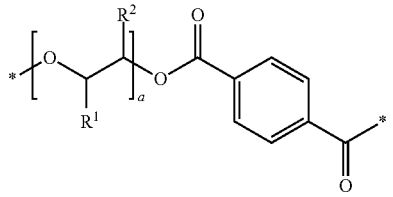

(II)

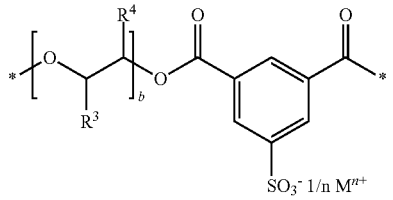

(III)

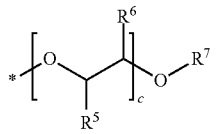

in which $R^1$, $R^2$, $R^3$, $R^4$, $R^5$ and $R^6$, independently of one another, each stand for hydrogen or methyl, $R^7$ stands for methyl, and/or a, b and c, independently of one another, each stand for a number from 1 to 200, in particular 1 to 20, particularly preferably 1 to 5, wherein extraordinarily preferably a and b=1 and/or c is a number from 2 to 10, and at least one polysaccharide comprising at least one anionic group, and (ii) at least one further of these chambers contains a liquid composition, containing at least one non-ionic aromatic polyester, containing at least one structural unit of formula (IV) and at least one structural unit of formula (V)

(IV)

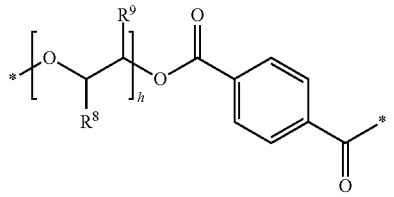

(V)

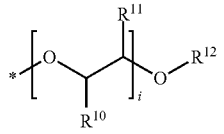

in which $R^8$, $R^9$, $R^{10}$ and $R^{11}$, independently of one another, each stand for hydrogen or methyl, and/or $R^{12}$ stands for methyl, and/or h and i, independently of one another, each stand for a number from 1 to 200, in particular 1 to 20, particularly preferably 1 to 5, wherein extraordinarily preferably h=1 and/or i is a number from 2 to 10, and at least one alkoxylated polyamine, wherein the portion contains at least one surfactant. The parameters of the agent as contemplated herein that are preferred as contemplated herein also apply, mutatis mutandis, to this particularly preferred and very particularly preferred embodiment.

Further preferred embodiments of the agent as contemplated herein (in particular the solid composition and the liquid composition of the portion) will be described hereinafter:

The agent as contemplated herein, in particular the solid composition of the portion as contemplated herein, can contain hydrogen carbonate.

Hydrogen carbonate is preferably contained in the solid composition of the portion in a total amount of from about 5 to about 50% by weight, particularly preferably from about 7.5 to about 30% by weight, calculated in each case as sodium hydrogen carbonate.

It is additionally preferred as contemplated herein to select hydrogen carbonate from sodium hydrogen carbonate, potassium hydrogen carbonate, or mixtures thereof. Sodium hydrogen carbonate is very particularly preferred as hydrogen carbonate.

It has additionally been found to be preferable for solving the object as contemplated herein if hydrogen carbonate is present in the form of particles, in particular as a powder or granules.

It is additionally preferred when the particles containing hydrogen carbonate (for example the powder or granules) have a bulk density of from about 0.40 to about 1.50 kg/dm$^3$, particularly preferably with a bulk density of from about 0.90 to about 1.10 kg/dm$^3$ (in each case measured in accordance with ISO 697). Within the scope of this preferred bulk density, it has proven to be advantageous and particularly preferred when the particles containing peroxide compound (for example the powder or granules) have a bulk density of from about 0.70 to about 1.30 kg/dm$^3$, particularly preferably with a bulk density of from about 0.85 to about 1.20 kg/dm$^3$ (in each case measured in accordance with ISO 697).

The agent as contemplated herein (in particular the solid composition of the portion) preferably contains alkali metal silicate. Suitable alkali metal silicates are, in particular, sodium silicate and/or potassium silicate. Sodium silicate is particularly preferred. Sodium metasilicate or waterglass are very particularly preferably used as sodium silicates, preferably waterglass.

It is preferred as contemplated herein when the contained alkali metal silicates are present in the form of particles, in particular as granules. In addition, alkali metal silicates of which the particles have a mean particle size (volume mean) $X_{50.3}$ of from about 0.20 to about 1.00 mm, in particular from about 0.30 to about 0.90 mm, in particular from about 0.50 to about 0.80 mm (for example measured with sieve analysis or by a Camsizer particle size analyzer from the company Retsch) are additionally preferably suitable.

Independently of this or in combination therewith, alkali metal silicates of formula $(SiO_2)_n(Na_2O)_m(K_2O)_p$ are particularly preferred as contemplated herein, wherein n stands for a positive rational number and m and p, independently of one another, stand for a positive rational number, with the provisions that at least one of the parameters m or p is different from 0 and the ratio between n and the sum of m and p is between about 1:4 and about 4:1, in particular in the ratio range of from about 2:1 to about 4:1.

In a particularly preferred embodiment as contemplated herein, the solid composition as contemplated herein contains, as alkali metal silicate, silicate of formula $(SiO_2)_n(Na_2O)_m$, wherein n stands for a positive rational number and m stands for a positive rational number, with the provision that the ratio between n and b is between about 1:4 and about 4:1, in particular in the ratio range of from about 2:1 to about 4:1.

In a further preferred embodiment as contemplated herein the agent as contemplated herein, in particular the solid composition as contemplated herein, contains at least one enzyme. In principle, all enzymes established in the prior art for the treatment of textiles can be used in this respect. Preferably one or more enzymes which can develop catalytic activity in a laundry detergent is/are used, in particular a protease, amylase, lipase, cellulose, hemicellulose, mannanase, pectin-cleaving enzyme, tannase, xylanase, xanthanase, β-glucosidase, carrageenase, perhydrolase, oxidase, oxidoreductase, and mixtures thereof. Preferred suitable hydrolytic enzymes include, in particular, proteases, amylases, in particular α-amylases, cellulases, lipases, hemicellulases, in particular pectinases, mannanases, β-glucanases, and mixtures thereof, with proteases being very particularly preferred. These enzymes are in principle of natural origin; proceeding from the natural molecules, improved variants are available for use in laundry detergents or cleaning agents and are used with preference accordingly.

These proteases are preferably those of the subtilisin type. Examples of this include the subtilisins BPN' and Carlsberg, the protease PB92, subtilisins 147 and 309, the alkaline protease from *Bacillus lentus*, subtilisin DY, and the enzymes thermitase, proteinase K, and proteases TW3 and TW7, which are assigned to subtilases, but not subtilisins in the narrower sense. The subtilisin Carlsberg is obtainable in developed form under the trade names Alcalase® from the company Novozymes A/S, Bagsvaerd, Denmark. Subtilisins 147 and 309 are sold under the trade names Esperase®, or Savinase®, from the company Novozymes. The protease variants managed under the name BLAP® derive from the protease from *Bacillus lentus* DS<5483. Further usable proteases are the enzymes obtainable for example under the trade names Durazym®, Relase®, Everlase®, Nafizym®, Natelase®, Kannase® and Ovozyme® from the company Novozymes, the enzymes obtainable under the trade names Purafect®, Purafect® OxP, Purafect® Prime, Excellase® and Properase® from the company Genencor, the enzyme obtainable under the trade name Protosol® from the company Advanced Biochemicals Ltd., Thane, India, the enzyme obtainable under the trade name Wuxi® from the company Wuxi Snyder Bioproducts Ltd., China, the enzymes obtainable under the trade names Proleather® and Protease P® from the company Amano Pharmaceuticals Ltd., Nagoya, Japan, and the enzyme obtainable under the name Proteinase K-16 from the company Kao Corp., Tokyo, Japan. The proteases from *Bacillus gibsonii* and *Bacillus pumilus* are also used with particular preference.

Examples of amylases that can be used as contemplated herein are the α-amylases from *Bacillus licheniformis*, from *B. amyloliquefaciens* or from *B. stearothermophilus*, and also the improved developments thereof for use in laundry detergents or cleaning agents. The enzyme from *B. licheniformis* is obtainable from the company Novozymes under the name Termamyl® and from the company Genencor under the name Purstar®ST. Development products of these α-amylases are obtainable from the company Novozymes under the trade names Duramyl® and Termamyl®ultra, from the company Genencor under the name Purastar®OxAm, and from the company Daiwa Seiko Inc., Tokyo, Japan, as Keistase®. The α-amylase from *B. amyloliquefaciens* is sold by the company Novozymes under the name BAN®, and derived variants of the α-amylase from *B. stearothermophilus* are sold under the names BSG® and Novamyl®, likewise by the company Novozymes. The α-amylase from *Bacillus* sp. A 7-7 (DSM 12368) and the cyclodextrin glucanotransferase (CGTase) from *B. agaradherens* (DSM 9948) should also be noted for this purpose. Fusion products of all specified molecules can also be used. In addition, the developments of α-amylases from *Aspergillus niger* and *A. oryzae* obtainable under the trade name Fungamyl® from the company Novozymes are also suitable. Further trade products that can be used with advantage are, for example, Amylase-LT® and Stainzyme® or Stainzyme Ultra® or Stainzyme Plus®, the latter also obtainable from the company Novozymes. Variants of these enzymes obtainable by point mutations can also be used as contemplated herein.

Examples of lipases or cutinases that can be used as contemplated herein and that in particular are contained on account of their triglyceride-cleaving activities, but also so as to produce peracids in situ from suitable precursors, are the lipases obtained or developed originally from *Humicola lanuginose* (*Thermomyces lanuginosus*), in particular those with the D96L amino acid substitution. They are sold for example by the company Novozymes under trade names Lipolase®, Lipolase®Ultra, LipoPrime®, Lipozyme® and Lipex®. Furthermore, cutinases which have been isolated originally from *Fusarium solani pisi* and *Humicola* can be used for example. Lipases that can also be used are obtainable from the company Amano under the names Lipase CE®, Lipase P®, Lipase B®, or Lipase CES®, Lipase AKG®, *Bacillus* sp. Lipase®, Lipase AP®, Lipase M-AP®, and Lipase AML®. By way of example the lipases and cutinases of which the starting enzymes have been isolated originally from *Pseudomonas mendocina* and *Fusarium solanii* and which are obtainable from the company Genencor can be used. Further important trade products that should be mentioned are the preparations M1 Lipase® and Lipoma sold originally by the company Gist-Brocades and the enzymes sold by the company Meito Sangyo KK, Japan, under the names Lipase MY-30®, Lipase OF® and Lipase PL®, and in addition the product Lumafast® from the company Genencor.

Depending on the purpose, cellulases can be provided as pure enzymes, as enzyme preparations, or in the form of mixtures in which the individual components are advantageously supplemented in respect of their various performance aspects. These performance aspects include, in particular, the contributions of the cellulases to the primary washing power of the agent (cleaning power), to the secondary washing power of the agent (anti-redeposition effect or anti-graying), to the finishing (effect on fabric) or to the exertion of a "stone-washed" effect. A usable fungal cellulose preparation rich in endoglucanase (EG), or developments thereof, is offered by the company Novozymes under the trade name Celluzyme®. The products Endolase® and Carezyme®, also obtainable from the company Novozymes, are based on 50 kD-EGs or 43 kD-EGs from *H. insolens* DSM 1800. Further trade products from this company that can be used are Cellusoft®, Renozyme® and Celluclean®. By way of example, 20 kD-EGs from *Melanocarpus*, which are obtainable from the company AB Enzymes, Finland, under the trade names Ecostone® and Biotuch®, can also be used. Further trade products from the company AB Enzymes are Econase® and Ecopulp®. Further suitable cellulases are obtainable from *Bacillus* sp. CBS 670.93 and CBS 669.93, wherein that from *Bacillus* sp. CBS 670.93 is obtainable from the company Genencor under the trade name Puradex®. Further trade products from the company Genencor are "Genencor detergent cellulose L" and IndiAge®Neutra. Variants of these enzymes obtainable by point mutations can also be used as contemplated herein. Particularly preferred cellulases are *Thielavia terrestris* cellulose variants, cellulases from *Melanocarpus*, in particular *Melanocarpus albomyces*, cellulases of the RGIII type from *Trichoderma reesei*, or variants obtainable therefrom.

Further enzymes summarized under the term hemicellulases can also be used, in particular in order to remove specific problem stains. These enzymes include, for example, mannanases, xanthanylases, xanthanases, xyloglucanases, xylanases, pullulanases, pectin-cleaving enzymes, and β-glucanases. The β-glucanase obtained from *Bacillus subtilis* is obtainable under the name Cereflo® from the company Novozymes. Hemicellulases that are particularly preferred as contemplated herein are mannanases, which for example are sold under the trade name Mannaway® by the company Novozymes or Purabrite® by the company Genencor. Within the scope of the subject disclosure, the pectin-cleaving enzymes also include enzymes with the names pectinase, pectatylase, pectinesterase, pectindemethoxylase, pectinmethoxylase, pectinmethylesterase, pectase, pectinmethylesterase, pectinoesterase, pectinpectylhydrolase, pectindepolymerase, endopolygalacturonase, pectolase, pectinhydrolyase, pectin-polygalacturonase, endopolygalacturonase, poly-α-1,4-galacturonid, glycanohydrolase, endoglalacturonase, endo-D-galacturonase, galacturan, 1,4-α-galacturonidase, exopolygalacturonase, poly(galacturonat) hydrolase, exo-D-galacturonase, exo-D-galacturonanase, exopoly-D-galacturonase, exo-poly-α-galacturinosidase, exopolygalacturonosidase, or exopolygalacturanosidase. Examples of enzymes suitable in this respect are obtainable, for example, under the names Gamanase®, Pektinex R®, X-Pect® or Pectaway® from the company Novozymes, under the name Rohapect UF®, Rohapect TPL®, Rohapect PTE 100®, Rohapect MPE®, Rohapect MA plus HC, Rohapect DA 12L®, Rohapect 10L® and Rohapect B1L® from the company AB Enzymes, and under the name Pyrolase® from the company Diversa Corp., San Diego, Calif., USA.

From all of these enzymes, those that are particularly preferred are those that have been stabilized in a comparatively stable manner or for example via point mutagenesis in relation to an oxidation. From these, in particular, the aforementioned trade products Everlase® and Purafect®OxP can be cited as examples for such proteases, and Duramyl® can be cited as an example of such an α-amylase.

The portion as contemplated herein contains enzymes preferably in total amounts of from about $1\times10^{-8}$ to about 5% by weight in relation to active protein. The enzymes are preferably contained in the portion in a total amount of from about 0.001 to about 2% by weight, more preferably from about 0.01 to about 1.5% by weight, even more preferably from about 0.05 to about 1.25% by weight, and particularly preferably from about 0.01 to about 0.5% by weight.

Regardless of the embodiment as a portion, structural materials, complexing agents, optical brighteners, pH adjusters, perfume, dye, dye transfer inhibitor, or mixtures thereof can also be contained in the agents as contemplated herein.

Organic structural materials which can be provided in the agents as contemplated herein are, for example, the polycarboxylic acids usable in the form of their sodium salts, wherein polycarboxylic acids are understood to mean carboxylic acids which carry more than one acid function. By way of example, these are citric acid, adipic acid, succinic acid, glutaric acid, malic acid, tartaric acid, maleic acid, fumaric acid sugar acids, amino carboxylic acids, and mixtures thereof. Preferred salts are the salts of polycarboxylic acids, such as citric acid, adipic acid, succinic acid, glutaric acid, tartaric acid, sugar acids, and mixtures thereof.

Polymeric polycarboxylates are also suitable as skeleton substances. These are, for example, the alkali metal salts of polyacrylic acid or polymethacrylic acid, for example those having a relative molecular mass of from about 600 to about 75,000 g/mol.

Suitable polymers are, in particular, polyacrylates that preferably have a molecular mass of from about 1,000 to about 15,000 g/mol. Due to their superior solubility, the short-chain polyacrylates, which have molar masses of from about 1,000 to about 10,000 g/mol, and particularly preferably from about 1,000 to about 5,000 g/mol, can be preferred, in turn, from this group.

Copolymer polycarboxylates are also suitable, in particular those of acrylic acid with methacrylic acid and of acrylic acid or methacrylic acid with maleic acid. In order to improve the water solubility, the polymers can also contain allyl sulfonic acids, such as allyloxybenzene sulfonic acid and methyl allyl sulfonic acid.

An organic optical brightener is preferably selected from the substance classes of distyrylbiphenyls, the stilbenes, the 4,4'-diamino-2,2'-stilbene disulfonic acids, the coumarins, the dihydroquinolinones, the 1,3-diarylpyrazolines, the naphthalic acid imides, the benzoxazole systems, the benzisoxazole systems, the benzimidazole systems, the pyrene derivatives substituted by heterocycles, and mixtures thereof.

Particularly preferred organic optical brighteners include disodium-4,4'-bis-(2-morpholino-4-anilino-s-triazin-6-ylamino)stilbene disulfonate (for example obtainable as Tinopal® DMS from BASF SE), disodium-2,2'-bis-(phenylstyryl)disulfonate (for example obtainable as Tinopal® CBS from BASF SE), 4,4'-bis[(4-anilino-6-[bis(2-hydroxyethyl)amino]-1,3,5-triazin-2-yl)amino]stilbene-2,2'-disulfonic acid (for example obtainable as Tinopal® UNPA from BASF SE), hexasodium-2,2'-[vinylene bis[3-sulphonato-4,1-phenylene)imino[6-(diethylamino)-1,3,5-triazine-4,2-diyl]imino]]bis-(benzene-1,4-disulfonate) (for example obtainable as Tinopal® SFO from BASF SE), 2,2'-(2,5-thiopenydiyl)bis[5-1,1-dimethyl)-benzoxazole (for example obtainable as Tinopal® SFP from BASF SE) and/or 2,5-bis(benzoxazol-2-yl) thiophene.

It is preferable that the organic dye transfer inhibitor is a polymer or copolymer of cyclic amines, such as vinyl pyrrolidone and/or vinyl imidazole. Polymers suitable as dye transfer inhibitor include polyvinyl pyrrolidone (PVP), polyvinylimidazole (PVI), copolymers of vinyl pyrrolidone and vinyl imidazole (PVP/PVI), polyvinylpyridine-N-oxide, poly-N-carboxymethyl-4-vinylpyridium chloride, polyethylene glycol-modified copolymers of vinyl pyrrolidone and vinyl imidazole, and mixtures thereof. Polyvinyl pyrrolidone (PVP), polyvinylimidazole (PVI), or copolymers of vinyl pyrrolidone and vinyl imidazole (PVP/PVI) are particularly preferred as dye transfer inhibitors. The used polyvinyl pyrrolidones (PVPs) preferably have an average molecular weight of from about 2,500 to about 400,000 and are commercially obtainable from ISP Chemicals as PVP K 15, PVP K 30, PVP K 60, or PVP K 90, or from BASF as Sokalan® HP 50 or Sokalan® HP 53. The used copolymers of vinyl pyrrolidone and vinyl imidazole (PVP/PVI) preferably have a molecular weight in the range of from about 5,000 to about 100,000. A PVP/PVI copolymer is commercially obtainable for example from BASF under the name Sokalan® HP 56. A further dye transfer inhibitor that can be used in an extremely preferred manner is constituted by polyethylene glycol-modified copolymers of vinyl pyrrolidone and vinyl imidazole, which for example are obtainable under the name Sokalan® HP 66 from BASF.

A second subject as contemplated herein is the use of an agent forming the first subject as contemplated herein for the treatment of textiles.

Within the scope of the use it is preferred when the agent as contemplated herein is provided in a portion of the embodiment described accordingly.

A third subject as contemplated herein is a method for treating textiles, containing the steps of dosing a composition forming the first subject as contemplated herein in order to produce a water-containing washing lye and bringing the resultant washing lye into contact with textiles.

Within the scope of the method it is preferred when the agent as contemplated herein is provided in a portion of the embodiment described accordingly.

The method is preferably characterized in that the agent forming the first subject as contemplated herein is used to produce the water-containing washing lye in an amount of from about 10 to about 100 g, in particular from about 20 to about 40 g, to about 10 to about 60 liters of water, in particular about 15 to about 40 liters of water.

The preferred embodiments described for the first subject as contemplated herein also apply, mutatis mutandis, to the second and third subjects as contemplated herein.

The following points illustrate preferred embodiments as contemplated herein:

1. An agent for use in the treatment of textiles, containing (i) at least one anionic, aromatic polyester, containing at least one structural unit of formula (I), at least one structural unit of formula (II), and at least one structural unit of formula (III)

(I)

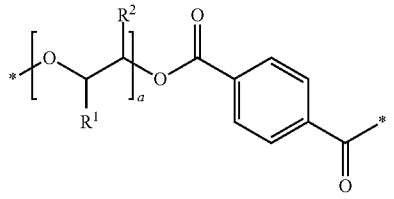

(II)

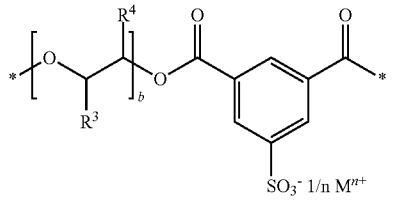

(III)

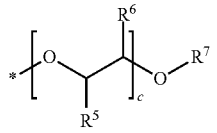

in which a, b and c, independently of one another, each stand for a number from 1 to 200, 1/n $M^{n+}$ stands for an equivalent of a cation having the valence n, with n=1, 2 or 3, $R^1$, $R^2$, $R^3$, $R^4$, $R^5$ and $R^6$, independently of one another, each stand for hydrogen or a $C_1$-$C_{18}$-n-alkyl group or $C_3$-$C_{18}$-iso-alkyl group, $R^7$ stands for a linear or branched $C_1$-$C_{30}$ alkyl group or for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, and (ii) at least one non-ionic, aromatic polyester, containing at least one structural unit of formula (IV) and at least one structural unit of formula (V)

(IV)

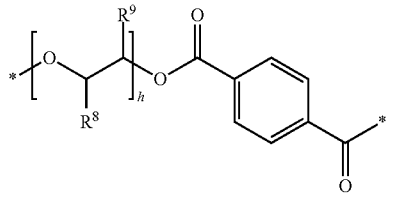

(V)

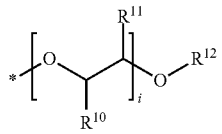

in which h and i, independently of one another, each stand for a number from 1 to 200, $R^8$, $R^9$, $R^{16}$ and $R^{11}$, independently of one another, each stand for hydrogen or a $C_1$-$C_{18}$-n- or -iso-alkyl group, $R^{12}$ stands for a linear or branched $C_1$-$C_{30}$ alkyl group or for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, and (iii) at least one surfactant.

2. The agent according to point 1, characterized in that the total amount of said anionic, aromatic polyester contained in the agent as contemplated herein contains a number average of 1 to 50 structural units of formula (I) and 1 to 50 structural units of formula (II)

3. The agent according to either one of points 1 or 2, characterized in that the total amount of said contained anionic, aromatic polyester contains, as a number average, between 1 and 25, in particular between 1 and 10, particularly preferably between 1 and 5, structural units of formula (I), and between 1 and 30, in particular between 2 and 15, particularly preferably between 3 and 10, structural units of formula (II), and between 0.05 and 15, in particular between 0.1 and 10, and particularly preferably between 0.25 and 3, structural units of formula (III).

4. The agent according to any one of points 1 to 3, characterized in that 1/n $M^{n+}$ according to formula (II) stands for $Li^+$, $Na^+$, $K^+$, ½$Mg^{2+}$, ½$Ca^{2+}$, ⅓$Al^{3+}$, $NH_4^+$, monoalkyldialkyl-, trialkyl- or tetraalkaylammonium, wherein the alkyl groups of the ammonium ions are $C_1$-$C_{22}$ alkyl groups or $C_2$-$C_{10}$ hydroxyalkyl groups or any mixtures thereof.

5. The agent according to any one of points 1 to 4, characterized in that, in formulas (I), (II) and (III) of the anionic, aromatic polyester, $R^1$, $R^2$, $R^3$, $R^4$, $R^5$ and $R^6$, independently of one another, each stand for hydrogen or methyl.

6. The agent according to any one of points 1 to 5, characterized in that, in formula (III) of the anionic, aromatic polyester, $R^7$ stands for methyl.

7. The agent according to any one of points 1 to 6, characterized in that, in formulas (I), (II), and (III) of the anionic, aromatic polyester, a, b and c, independently of one another, each stand for a number from 1 to 200 (in particular from 1 to 20, particularly preferably 1 to 5, wherein extraordinarily preferably a and b=1 and c is a number from 2 to 10).

8. The agent according to any one of points 1 to 7, characterized in that said anionic, aromatic polyesters are solid and have softening points above about 40° C. (preferably between about 50 and about 200° C., particularly preferably between about 80° C. and about 150° C. and extraordinarily preferably between about 100° C. and about 120° C.).

9. The agent according to any one of points 1 to 8, characterized in that, in relation to the total weight of the agent, said anionic, aromatic polyesters are contained in a total amount of from about 0.5 to about 8.0% by weight, in particular from about 1.0 to about 5.0% by weight.

10. The agent according to any one of points 1 to 9, characterized in that, in accordance with formulas (IV) and (V) of the non-ionic, aromatic polyester, $R^8$, $R^9$, $R^{10}$ and $R^{11}$, independently of one another, each stand for hydrogen or methyl.

11. The agent according to any one of points 1 to 10, characterized in that $R^{12}$, in accordance with formula (V) of the non-ionic, aromatic polyester, stands for methyl.

12. The agent according to any one of points 1 to 11, characterized in that h and i, independently of one another, each stand for a number from 1 to 200, in particular 1 to 20.
13. The agent according to any one of points 1 to 12, characterized in that the total amount of said contained non-ionic, aromatic polyester contains, in each case as a number average, between 1 and 25, in particular between 1 and 10 (particularly preferably between 1 and 5), structural units of formula (IV), and between 0.05 and 15 (in particular between 0.1 and 10, and particularly preferably between 0.25 and 3) structural units of formula (V).
14. The agent according to any one of points 1 to 13, characterized in that, in relation to the total weight of the agent, said non-ionic, aromatic polyesters are contained in a total amount of from about 0.5 to about 8.0% by weight, in particular from about 1.0 to about 5.0% by weight.
15. The agent according to any one of points 1 to 14, characterized in that it contains at least one anionic surfactant and at least one non-ionic surfactant.
16. The agent according to any one of points 1 to 15, characterized in that surfactants are contained in a total amount of from about 40 to about 70% by weight, in particular from about 50 to about 60% by weight.
17. The agent according to any one of points 1 to 16, characterized in that it additionally contains at least one polyalkoxylated polyamine.
18. The agent according to point 17, characterized in that, in relation to the total weight thereof, alkoxylated polyamine is contained in a total amount of from about 0.25 to about 7.5% by weight, in particular from about 1.0 to about 5.0% by weight.
19. The agent according to any one of points 1 to 17, characterized in that it comprises at least two compositions, wherein one of these compositions is a solid composition and a further of these compositions is a liquid composition.
20. The agent according to point 19 in the form of a portion, comprising at least two chambers having walls made of water-soluble material, wherein, in each case,
    (i) at least one of these chambers contains a solid composition comprising at least one anionic, aromatic polyester according to any one of points 1 to 9, and
    (ii) at least one further of these chambers contains a liquid composition comprising at least one non-ionic, aromatic polyester according to any one of points 10 to 14,
    wherein the portion contains at least one surfactant.
21. The agent according to point 20, characterized in that the total amount of surfactant in the liquid composition of the portion is up to about 85% by weight, preferably about 40 to about 75% by weight, and particularly preferably about 50 to about 70% by weight, in each case in relation to the total liquid composition of the portion.
22. The agent according to any one of points 20 or 21, characterized in that at least one polysaccharide is contained in the solid composition.
23. The agent according to any one of points 20 to 22, characterized in that at least one alkoxylated polyamine is contained in the liquid composition.
24. A method for treating textiles, containing the steps of dosing an agent according to any one of points 1 to 23 so as to produce a water-containing washing lye and bringing the resultant washing lye into contact with textiles.
25. The method according to point 24, characterized in that the agent is used in an amount of from about 10 to about 100 g, in particular from about 20 to about 40 g, to about 10 to about 60 liters of water, in particular about 15 to about 40 liters of water.

EXAMPLES 1.0 Preparation of the Compositions

The following compositions in Tables 1 and 2 were prepared:

TABLE 1

| Solid compositions (amounts in % by weight): | F1 | F2 | F3 |
|---|---|---|---|
| $C_{11-13}$ alkylbenzene sulfonic acid, sodium salt | 20.0 | 20.0 | 20.0 |
| $C_{12-18}$ fatty alcohol sulfate, sodium salt | 3.84 | 3.84 | 3.84 |
| Carboxymethylcellulose | 9.00 | 9.00 | 9.00 |
| Inorganic, aromatic polyester from terephthalic acid, 1,2-propylene glycol, 5-sulfoisophthalic acid | 9.00 | — | 11.93 |
| Copolymer of vinyl imidazole and vinyl pyrrolidone | 1.30 | 1.30 | 1.30 |
| Enzymes | 0.7 | 0.7 | 0.7 |
| Sodium sulfate | 10.0 | 10.0 | 10.0 |
| $C_{18}$ fatty acid, sodium salt | 2.6 | 2.6 | 2.6 |
| Zeolite A | 7.5 | 7.5 | 7.5 |
| Sodium hydrogen carbonate | to 100 | to 100 | to 100 |

The components were added in sequence into a tumble mixer, and the compositions were produced by dry mixing of the components for 3 min at 10 revolutions/minute.

TABLE 2

| Liquid composition | L1 [% by weight] | L2 [% by weight] | L3 [% by weight] |
|---|---|---|---|
| $C_{11-13}$ alkylbenzene sulfonic acid | 23.0 | 23.0 | 23.0 |
| $C_{13-15}$ alkyl alcohol ethoxylated with 8 mol ethylene oxide | 24.0 | 24.0 | 24.0 |
| Glycerol | 8.00 | 8.00 | 8.00 |
| 2-aminoethanol | 6.9 | 6.9 | 6.9 |
| Ethoxylated polyethylene imine | 5.0 | 5.0 | 5.0 |
| $C_{12-18}$ fatty acid | 7.5 | 7.5 | 7.5 |
| Diethylene triamine-N,N,N',N',N''-penta(methylene phosphonic acid), heptasodium salt (sodium DTPMP) | 1.2 | 1.2 | 1.2 |
| 1,2-propylene glycol | 5.8 | 5.8 | 5.8 |
| Ethanol | 3.0 | 3.0 | 3.0 |
| Soil-release polymer from ethylene terephthalate and polyethylene oxide terephthalate | 1.4 | 5.65 | — |
| Perfume, dye | 2.0 | 2.0 | 2.0 |
| Water | to 100 | to 100 | to 100 |

The components of the liquid composition were mixed in sequence in a stirrer tank, with stirring.

The following portions were produced:

TABLE 3

| Portions | E1 | V1 | V2 |
|---|---|---|---|
| Solid composition | 8.5 g F1 | 8.5 g F2 | 8.5 g F3 |
| Liquid composition | 16.5 g L1 | 16.5 g L2 | 8.5 g L3 |
| Total amount of aromatic polyester as contemplated herein per washing load | 0.93 g | 0.93 g | 0.93 g |

For this purpose, an M613 film from the company Monosol (88 μm) was stretched over a mold having a double cavity. The stretched film was heated for a period of 2400 ms at 105° C. by contact heating and was then drawn by a vacuum into the cavity. A suitable amount of the solid composition of Table 1 was then pre-weighed, filled into the first cavity, and then the amount of the liquid composition L1 from Table 2 was introduced into the second cavity by means of a syringe. An upper film (M8630, 90 μm) was then applied in order to close the cavities and was welded to the first film by means of heat (150° C., 1,000 ms). Once the vacuum was broken, the portion was removed from the cavity. A wall of the powder chamber of the portion was then perforated using a needle. Excess air thus escaped from the powder chamber of the portion, and the film of the wall relaxed.

2.0 Washing Test

In order to determine the "soil release" power of the portions, various cloth rags made of polyester were washed at least three times using a portion E1, V1 or V2 in a domestic washing machine (Miele W 1514) with 3.5 kg of accompanying laundry at 40° C. and were then provided with fat-containing stains each having a diameter of approximately 2 cm.

A domestic washing machine (Miele W 114) was then loaded with 3.5 kg of accompanying laundry and also the soiled cloth rags made of polyester. In addition, a corresponding portion to be tested was added, and six washes at 40° C. were performed.

Once the cloth rags had been hung to dry and passed through a mangle, the cleaning degree of the portions was determined visually. It was found that the portion E1 as contemplated herein had a higher cleaning degree compared to the portions V1 and V2 not as contemplated herein.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

The invention claimed is:

1. A portion comprising an agent for use in the treatment of textiles, wherein the agent comprises:

(i) at least one anionic, aromatic polyester, containing at least one structural unit of formula (I), at least one structural unit of formula (II), and at least one structural unit of formula (III)

(I)

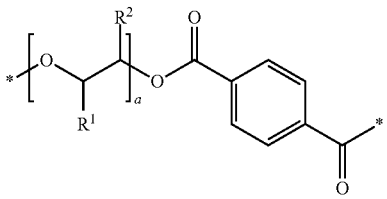

-continued (II)

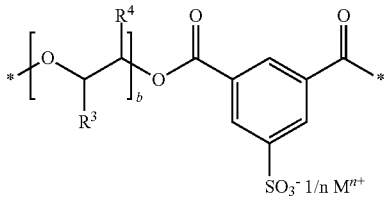

(III)

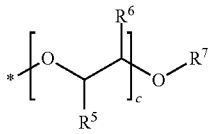

in which a, b and c, independently of one another, each stand for a number from 1 to 200, $1/n\ M^{n+}$ stands for an equivalent of a cation having the valence n, with n =1, 2 or 3, $R^1$, $R^2$, $R^3$, $R^4$, $R^5$ and $R^6$, independently of one another, each stand for hydrogen, a $C_1$-$C_{18}$-n-alkyl group, or a $C_3$-$C_{18}$-iso-alkyl group, $R^7$ stands for a linear or branched $C_1$-$C_{30}$ alkyl group, for a linear or branched $C_2$-$C_{30}$ alkenyl group, for a cycloalkyl group having 5 to 9 carbon atoms, for a $C_6$-$C_{30}$ aryl group, or for a $C_6$-$C_{30}$ arylalkyl group, (ii) at least one non-ionic, aromatic polyester, containing at least one structural unit of formula (IV) and at least one structural unit of formula (V)

(IV)

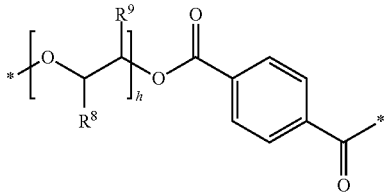

(V)

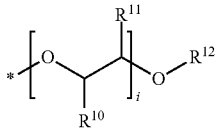

in which h and i, independently of one another, each stand for a number from 1 to 200, $R^8$, $R^9$, $R^{10}$ and $R^{11}$, independently of one another, each stand for hydrogen, a $C_1$-$C_{18}$-n-alkyl group, or -iso-alkyl group, $R^{12}$ stands for a linear or branched $C_1$-$C_{30}$ alkyl group, for a linear or branched $C_2$-$C_{30}$ alkenyl group, for a cycloalkyl group having 5 to 9 carbon atoms, for a $C_6$-$C_{30}$aryl group, or for a $C_6$-$C_{30}$ arylalkyl group, and (iii) at least one surfactant, wherein the agent is separated into at least two compositions in the portion, wherein one of the compositions is a solid composition and a further of the compositions is a liquid composition.

2. The portion according to claim 1, wherein the total amount of said anionic, aromatic polyester has a number average of 1 to 50 structural units of formula (I) and 1 to 50 structural units of formula (II).

3. The portion according to claim 1, wherein the total amount of said anionic, aromatic polyester has, as a number average, between 1 and 25 structural units of formula (I), between 1 and 30 structural units of formula (II), and between 0.05 and 15 structural units of formula (III).

4. The portion according to claim 1, wherein, in formulas (I), (II) and (II) of the anionic, aromatic polyester, $R^1$, $R^2$, $R^3$, $R^4$ , $R^5$ and $R^6$, independently of one another, each stand for hydrogen or methyl.

5. The portion according to claim 1, wherein, in formulas (I), (II), and (III) of the anionic, aromatic polyester, a, b, and c, independently of one another, each stand for a number from 1 to 20.

6. The portion according to claim 1, wherein said anionic, aromatic polyesters are solid and have softening points above 40° C.

7. The portion according to claim 1, wherein, in relation to the total weight of the agent, said anionic, aromatic polyesters are contained in a total amount of from 0.5 to 8.0% by weight.

8. The portion according to claim 1, wherein, in accordance with formulas (IV) and (V) of the non-ionic, aromatic polyester, $R^8$, $R^9$, $R^{10}$ and $R^{11}$, independently of one another, each stand for hydrogen or methyl.

9. The portion according to claim 1, wherein $R^{12}$, in accordance with formula (V) of the non-ionic, aromatic polyester, stands for methyl.

10. The portion according to claim 1, wherein h and i, independently of one another, each stand for a number from 1 to 20.

11. The portion according to claim 1, wherein the total amount of said non-ionic, aromatic polyester includes, as a number average, between 1 and 25 structural units of formula (IV), and between 0.05 and 15 structural units of formula (V).

12. The portion according to claim 1, wherein, in relation to the total weight of the agent, said non-ionic, aromatic polyesters are contained in a total amount of from 0.5 to 8.0% by weight.

13. The portion according to claim 1, wherein the at least one surfactant (iii) comprises at least one anionic surfactant and at least one non-ionic surfactant.

14. The portion according to claim 1, wherein a total amount of surfactants (iii) are present in a total amount of from about 40 to about 70% by weight.

15. The portion according to claim 1 comprising at least two chambers having walls formed from water-soluble material, wherein, (i) at least one of the chambers comprises the solid composition and wherein the solid composition comprises the at least one anionic, aromatic polyester (i), and (ii) at least one further of the chambers contains the liquid composition and wherein the liquid composition comprises the at least one non-ionic, aromatic polyester, wherein the portion further comprises the at least one surfactant (iii).

16. The portion according to claim 15, wherein the total amount of surfactant (iii) in the liquid composition of the portion is up to about 85% by weight based on the total weight of the liquid composition of the portion.

17. The portion according to claim 1, wherein the total amount of said anionic, aromatic polyester has, as a number average, between 1 and 5 structural units of formula (I), between 3 and 10 structural units of formula (II), and between 0.25 and 3 structural units of formula (III).

18. The portion according to claim 1, wherein, in formulas (I), (II), and (III) of the anionic, aromatic polyester, a, b, and c, independently of one another, each stand for a number from 1 to 5, and wherein h and i, independently of one another, each stand for a number from 1 to 20.

19. The portion according to claim 1, wherein the total amount of said non-ionic, aromatic polyester includes, as a number average, between 1 and 5 structural units of formula (IV), and between 0.25 and 3 structural units of formula (V).

20. The portion according to claim 16, wherein the total amount of surfactant (iii) in the liquid composition of the portion is about 40 to about 75% by weight based on the total weight of the liquid composition of the portion.

* * * * *